US005427540A

United States Patent [19]

Taguchi

[11] Patent Number: 5,427,540

[45] Date of Patent: Jun. 27, 1995

[54] LEVER-COUPLING-TYPE CONNECTOR

[75] Inventor: Naoto Taguchi, Shizuoka, Japan

[73] Assignee: Yazaki Corporation, Japan

[21] Appl. No.: 189,877

[22] Filed: Feb. 1, 1994

[30] Foreign Application Priority Data

Feb. 2, 1993 [JP] Japan ..... 5-015260

[51] Int. Cl.[6] ..... H01R 13/62

[52] U.S. Cl. ..... 439/157; 439/160

[58] Field of Search ..... 439/152–160, 439/372

[56] References Cited

U.S. PATENT DOCUMENTS

| | | | |
|---|---|---|---|
| 4,586,766 | 5/1986 | Hofmeister | 439/160 |
| 4,648,009 | 3/1987 | Beun et al. | 439/160 |
| 4,990,096 | 2/1991 | Bujtas et al. | 439/157 |
| 5,178,553 | 1/1993 | Hatagishi et al. | 439/157 |
| 5,238,417 | 8/1993 | Hatagishi | 439/153 |
| 5,269,696 | 12/1993 | Okada et al. | 439/140 |
| 5,362,245 | 11/1994 | Suguro et al. | 439/160 |
| 5,368,492 | 11/1994 | Hayashi | 439/157 |

FOREIGN PATENT DOCUMENTS

| | | | |
|---|---|---|---|
| 4-286881 | 12/1992 | Japan . | |
| 5-290921 | 5/1993 | Japan . | |
| 2179506 | 3/1987 | United Kingdom | 439/372 |

*Primary Examiner*—Larry I. Schwartz
*Assistant Examiner*—Jill DeMello
*Attorney, Agent, or Firm*—Wigman, Cohen, Leitner & Myers

[57] ABSTRACT

A lever-coupling-type connector having a first connector and a second connector to be coupled with or separated from the first connector by a lever, includes a first connector main body, a second connector main body, a lever, bearing device for pivotably supporting the lever on the first connector. This bearing device is capable of holding an axis around which the lever rotate at a first position and a second position. The lever-coupling-type connector further includes a driving pin and a cam groove. This cam groove has an opening for receiving the driving pin. A lever-coupling-type connector further includes a projection and a recess provided for the lever to engage with the projection. This recess is capable of engaging with the projection when the axis is located at the first position, but the recess is not engaged with the projection when the axis is located at the second position. A lever-coupling-type connector further includes a step portion which is pressed by the driving pin introduced from the opening.

3 Claims, 3 Drawing Sheets

LEVER-COUPLING-TYPE CONNECTOR

BACKGROUND OF THE INVENTION

1. Technical Field

The present invention generally relates to wire-harness connection for use in automobiles, and particularly to a lever-coupling-type connector in which a pair of female and male connectors are engaged or disengaged by a pivot lever.

2. Background Art

The lever-coupling-type connector (Japan Laid Open Hei 5-290921) has a pair of female and male connectors to be coupled with each other. The female connector is provided with a pivotable lever in which cam grooves are formed for respectively receiving driving pins provided in the male connector. In such a lever-coupling-type connector, the engagement or disengagement between the female and male connectors is carried out by forward or backward movement of the pins in the respective cam grooves by the pivot movement of the lever.

In this case, it is necessary for coupling these connectors together to engage the driving pins in advance with the respective open ends of the cam grooves. Thus, it is also necessary to hold the open end of each cam groove at a location where the corresponding pin can be received therein. For this purpose, a spring for biasing the lever is required.

Accordingly, the structure of the above lever-coupling-type connector must be complicated due to such a spring and a mechanism necessary for holding it, thereby to raise the assembly cost.

SUMMARY OF THE INVENTION

It is an object of the present invention to provide a lever-coupling-type connector in which the lever can be held at a location engageable to the mating connector without using the spring for biasing the lever.

To achieve the above object, the present invention provides a lever-coupling-type connector having a first connector and a second connector to be coupled with or separated from the first connector by a lever, includes a first connector main body, a second connector main body to be coupled with the first connector main body, a lever pivotably provided for the first connector, bearing device for pivotably supporting the lever on the first connector. This bearing device is capable of holding said lever so that an axis around which the lever rotates is located at a first position and a second position. The lever-coupling-type connector further includes a driving pin provided for the second connector main body, and a cam groove formed in the lever to engage with the driving pin. This cam groove has an opening for receiving the driving pin in the cam groove. A lever-coupling-type connector further includes a projection provided for the first connector main body, and a recess provided for the lever to engage with the projection. This recess is capable of engaging with the projection when the axis is located at the first position so as to hold the lever at a location where the opening can receive the driving pin, but this recess is not engaged with the projection when the axis is located at the second position so as to make the lever rotatable. A lever-coupling-type connector further includes a step portion provided for said cam groove. This step portion is pressed by the driving pin introduced from the opening to move the axis from the first position to the second position.

Thus, the axis of the lever is moved from the first position to the second position to make the lever pivotable. Accordingly, the inventive structure can be simplified without requiring any spring mechanism, thereby to reduce the assembly cost.

These and other objects, features and advantages of the present invention will be more apparent from the following description of a preferred embodiment, taken in conjunction with the accompanying drawings.

DESCRIPTION OF THE PREFERRED EMBODIMENT

Figure 1:
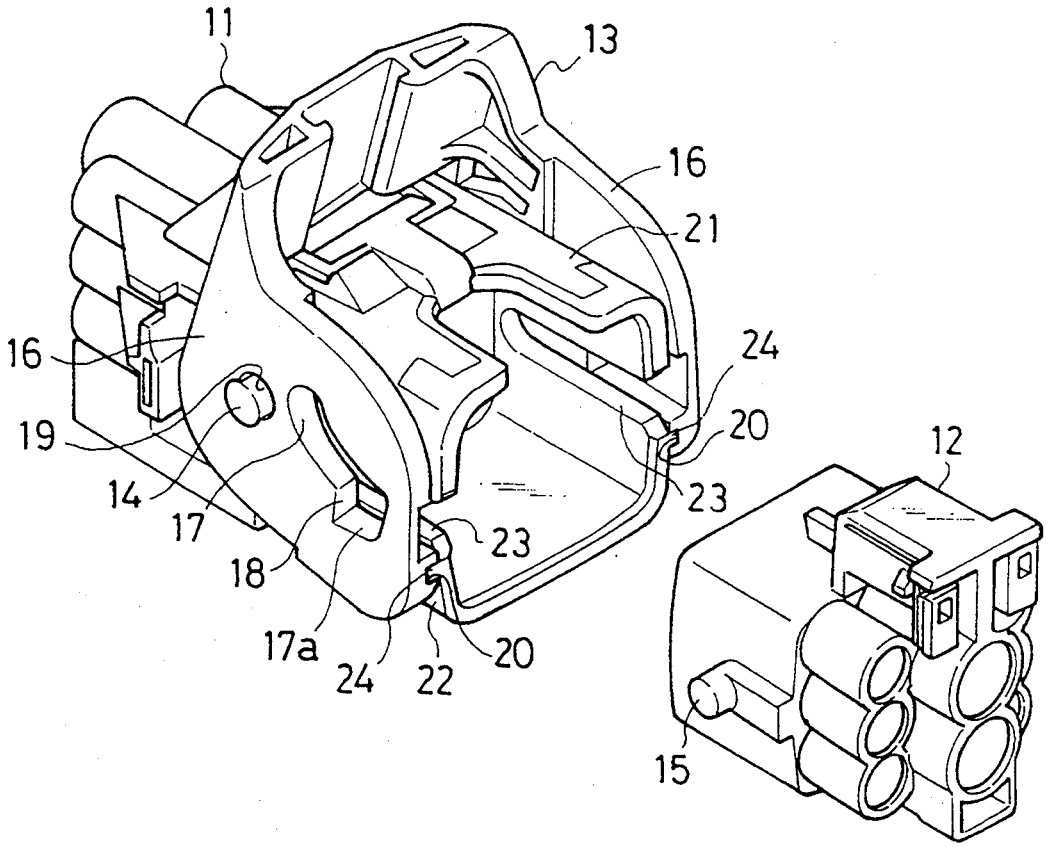
FIG. 1 is a perspective view showing a state in which the female and male connectors of the lever-coupling-type connector according to the present invention are separated from each other.

Hereinafter, an embodiment of the present invention will be described with reference to FIGS. 1 to 4.

In the drawings reference numeral 11 denotes a female connector and 12 shows a male connector. These female and male connectors 11, 12 are provided with metal terminals (not shown) in their interiors, respectively. Moreover, the female connector 11 has a lever 13. The lever 13 is provided for the engagement or disengagement to the male connector 12, and is pivotably mounted about a support shaft 14 provided in the female connector 11. On the other hand, on both sides of the male connector 12 driving pins 15 are provided to be driven by lever 13.

Figure 4:
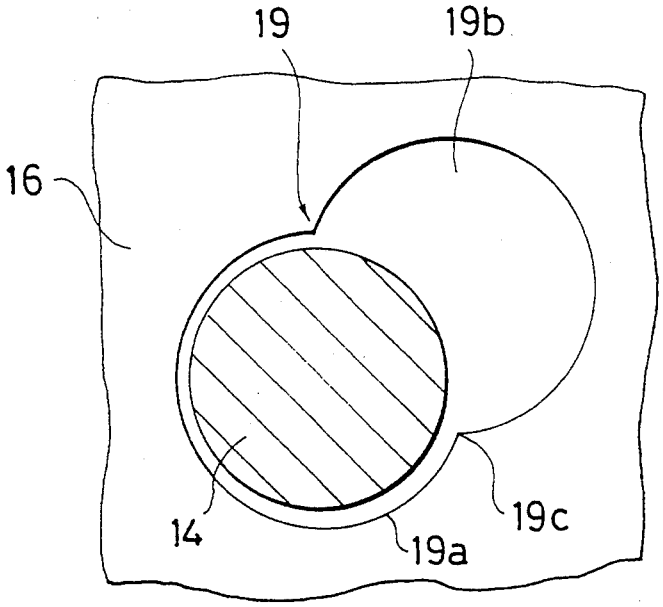
FIG. 4 is a diagram showing the relation between the lever pivot shaft and the bearing mechanism.

Driving cam grooves 17 are formed in opposing cam-plate portions 16, 16 of lever 13. Each cam groove 17 has an arcuate shape, and an engaging step portion 18 is provided at its introducing portion 17*a*. On the other hand, in the cam-plate portions 16, 16, bearing portions 19, 19 are formed to receive the support shaft 14 respectively. As shown in FIG. 4, each bearing portion 19 has a first bearing portion 19*a*, a second bearing portion 19*b* and a narrowed portion 19*c*. These first and second bearing portions 19*a* and 19*b* are formed into arcuate shapes for fitting around the support shaft 14. That is, the second bearing portion 19*b* is so formed as to be an eccentric circle of the first bearing portion 19*a* via the narrowed portion 19*c*. Further, each cam plate portion 16 includes a recessed portion 20 at its forward end.

In addition, a pair of notched portions 23 for guiding the driving pins are formed horizontally in both opposing side walls 22 of a cover 21 provided in the female connector 11. At the forward end of each side wall 22 a projection 24 is formed laterally projecting to determine the initial position.

Figure 2:
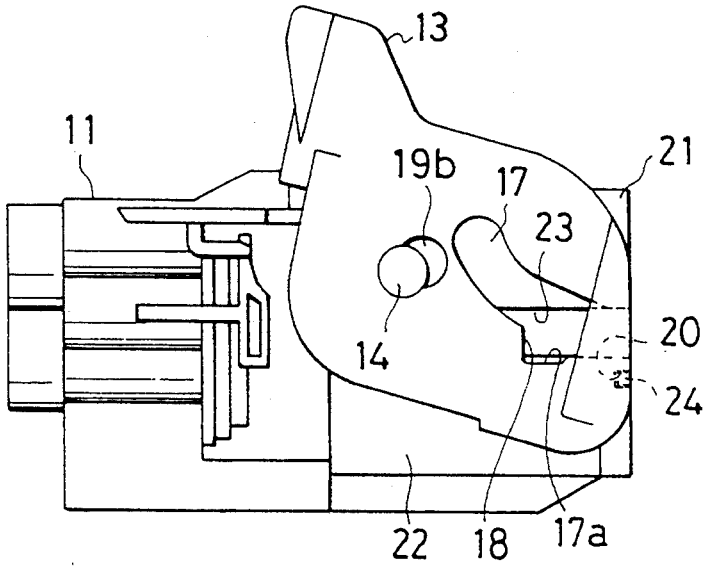
FIG. 2 is a side view of the female connector of the lever-coupling-type connector of FIG. 1.

The lever 13 comprises a synthetic resin, and is thus joined with the female connector 11 by engaging the bearing portions 19 with the support shaft 14 opening both the cam plate portions 16, 16. In that engagement, as shown in FIGS. 1 and 2, each first bearing portion 19*a* receives the support shaft 14, and each recessed portion 20 is engaged with each initial-position determining projection 24. Thus, the pivot movement of lever 13 is prevented.

Figure 3:
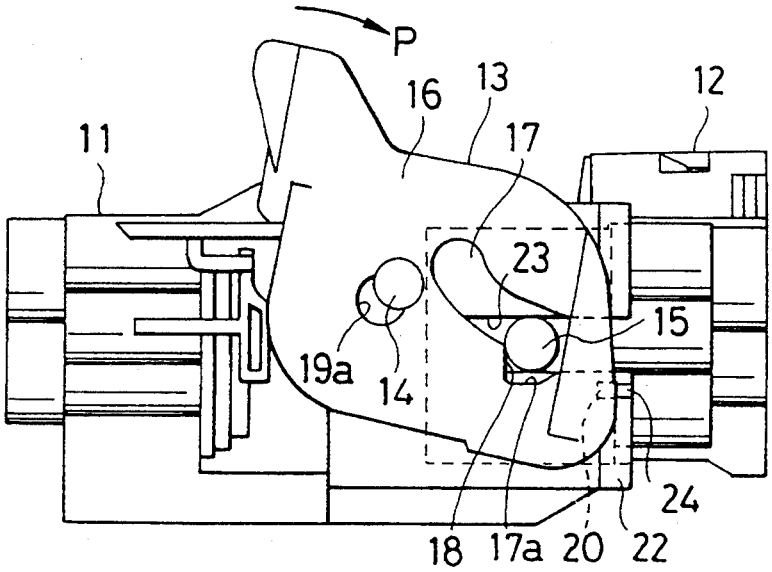
FIG. 3 is a side view showing a state in which the male connector is inserted in the female connector of FIG. 2.

When the male connector 12 is inserted in the cover 21 of female connector 11, the driving pins 15 are moved along the notched guide portions 23, respectively. In that manner the distal end of each driving pin 15 pushes backward the engaging step portion 18 of the introducing portion 17*a*. Thus, the entire body of lever 13 is forced backward, as well as, each bearing portion 19 is moved in the same direction. As a result, the support shaft 14 moves to the second bearing portions 19*b* from the first bearing portions 19*a* across the narrowed portions 19*c*. In that movement, each recessed portion 20 of lever 13 is removed from the initial position determining projection 24 to make the lever 13 pivotable along the arrow P as shown in FIG. 3. Since the minimum gap of narrowed portion 19*c* between the first and second bearing portions 19*a* and 19*b* is slightly smaller than the outer diameter of support shaft 14, the engagement between the support shaft 14 and the second bearing portion 19*b* can be stably maintained.

As stated above, by the selectively removable engagement between the recessed portions 20 and the initial position determining projections 24, the lever 13 of female connector 11 can be held securely at its initial position and pivot along a desired direction after insertion of the mating connector 12, without using the spring mechanism required in the prior art. Accordingly, the structure can be simplified, and the assembly cost can be reduced.

Various modifications will become possible for those skilled in the art after receiving the teachings of the present disclosure without departing from the scope thereof.

What is claimed is:

1. A lever-coupling-type connector having a first connector and a second connector to be coupled with or separated from the first connector by a lever, comprising:

a first connector main body;

a second connector main body to be coupled with said first connector main body;

a lever pivotably provided for said first connector;

bearing means for pivotably supporting said lever on said first connector, said bearing means being capable of holding said lever so that an axis around which said lever rotates is located at a first position and a second position;

a driving pin provided for said second connector main body;

a cam groove formed in said lever to engage with said driving pin, said cam groove having an opening for receiving said driving pin in said cam groove;

a projection provided for said first connector main body;

a recess provided for said lever to engage with said projection, said recess being capable of engaging with said projection when said axis is located at said first position so as to hold said lever at a location where said opening can receive said driving pin, but said recess being not engaged with said projection when said axis is located at said second position so as to make said lever rotatable; and a step portion provided for said cam groove, said step portion being pressed by said driving pin introduced from said opening to move said axis from said first position to said second position.

2. A lever-coupling-type connector according to claim 1, wherein said bearing means includes:

a support shaft provided for said first connector main body;

a first bearing for receiving said support shaft when said axis is located at said first position;

a second bearing for receiving said support shaft when said axis is located at said second position;

a narrow portion communicating said first bearing with said second bearing and having a minimum gap slightly smaller than an outer diameter of said support shaft, said narrow portion stably holding said support shaft in said first bearing or in said second bearing.

3. A lever-coupling-type connector according to claim 1, wherein:

said cam groove is formed into an arcuate shape.

* * * * *